US009988843B2

(12) United States Patent
Lee

(10) Patent No.: US 9,988,843 B2
(45) Date of Patent: Jun. 5, 2018

(54) IMPACT BODY FOR HYDRAULIC IMPACT DEVICE

(71) Applicant: Il Jae Lee, Suwon-si (KR)

(72) Inventor: Il Jae Lee, Suwon-si (KR)

( * ) Notice: Subject to any disclaimer, the term of this patent is extended or adjusted under 35 U.S.C. 154(b) by 639 days.

(21) Appl. No.: 14/411,993

(22) PCT Filed: Jun. 21, 2013

(86) PCT No.: PCT/KR2013/005484

§ 371 (c)(1),
(2) Date: Dec. 30, 2014

(87) PCT Pub. No.: WO2014/007477

PCT Pub. Date: Jan. 9, 2014

(65) Prior Publication Data

US 2015/0197988 A1 Jul. 16, 2015

(30) Foreign Application Priority Data

Jul. 3, 2012 (KR) ..... 10-2012-0072428

(51) Int. Cl.
*B25D 9/12* (2006.01)
*B25D 9/18* (2006.01)
(Continued)

(52) U.S. Cl.
CPC ..... *E21B 4/14* (2013.01); *B25D 9/12* (2013.01); *B25D 9/18* (2013.01); *B25D 17/00* (2013.01);
(Continued)

(58) Field of Classification Search
CPC ..... B25D 2217/0019; B25D 9/26
(Continued)

(56) References Cited

U.S. PATENT DOCUMENTS 3,714,789 A * 2/1973 Chelminski ..... E02D 7/00 173/1
3,788,402 A * 1/1974 Chelminski ..... E02D 7/00 173/127
(Continued)

FOREIGN PATENT DOCUMENTS

KR 1996-0006735 B1 5/1996
KR 10-0422093 B1 3/2004
(Continued)

OTHER PUBLICATIONS

WIPO, International Search Report (PCT/KR2013/005484), dated Aug. 22, 2013.

*Primary Examiner* — Thanh Truong
*Assistant Examiner* — Patrick Fry
(74) *Attorney, Agent, or Firm* — Park & Associates IP Law, P.C.

(57) ABSTRACT

The present invention relates to a impact body for a hydraulic impact device and, more specifically, to a impact body for a hydraulic impact device which is capable of remarkably reducing production costs by inserting a cylinder liner having a flow path into an inner wall of a body, adjusting an impact interval and an impact strength according to the properties of a material to be crushed by adjusting an impact distance of a piston, minimizing the loss of a fluid in a pipe by forming a cylindrical flow path between the body and the cylinder liner, and remarkably improving performance by employing a circular valve to shorten the flow path whereby reduction of pressure is minimized.

3 Claims, 7 Drawing Sheets

(51) Int. Cl.
*B25D 17/00* (2006.01)
*E02D 7/10* (2006.01)
*E21B 4/14* (2006.01)

(52) U.S. Cl.
CPC ..... *E02D 7/10* (2013.01); *B25D 2250/065* (2013.01); *B25D 2250/105* (2013.01); *B25D 2250/121* (2013.01); *B25D 2250/231* (2013.01)

(58) Field of Classification Search
USPC ..... 173/90
See application file for complete search history.

(56) References Cited

U.S. PATENT DOCUMENTS 3,991,835 A * 11/1976 Bailey ..... B25D 9/14 173/206
3,998,279 A * 12/1976 Bailey ..... B25D 9/12 173/105
4,028,995 A 6/1977 Salmi
4,062,411 A * 12/1977 Adkins ..... B25D 9/26 173/115
4,075,858 A * 2/1978 Frederick ..... E02D 7/10 173/125
4,724,911 A * 2/1988 Buske ..... B25D 9/12 173/202
4,977,966 A * 12/1990 Farber ..... B25B 21/026 173/159
5,311,950 A * 5/1994 Spektor ..... E21B 4/145 173/137
5,477,680 A * 12/1995 Heskey ..... B25B 27/10 173/148
8,151,900 B2 * 4/2012 Piras ..... B25D 9/145 137/625
8,733,468 B2 * 5/2014 Teipel ..... B25D 9/12 173/135
2003/0183402 A1 * 10/2003 Piras ..... B25D 9/20 173/206
2012/0138328 A1 * 6/2012 Teipel ..... B25D 9/12 173/207

FOREIGN PATENT DOCUMENTS

KR 10-0456786 B1 11/2004
KR 10-0510966 B1 8/2005
KR 10-0675586 B1 1/2007
KR 10-0772301 B1 11/2007
KR 10-0966740 B1 6/2010
KR 10-0998261 B1 12/2010
KR 10-2011-0086289 A 7/2011

* cited by examiner

IMPACT BODY FOR HYDRAULIC IMPACT DEVICE

REFERENCE TO RELATED APPLICATIONS

This application is a U.S. National Phase application of pending International Application No. PCT/KR2013/005484 filed on Jun. 21, 2013, and claims priority of Korean Patent Application No. 10-2012-0072428 filed on Jul. 3, 2012, the entire contents of which are incorporated herein by reference.

FIELD OF THE INVENTION

The present invention relates to a hitting body for a hydraulic hitting device and, more specifically, to a hitting body for a hydraulic hitting device which is capable of remarkably reducing production costs by inserting a cylinder liner having a flow path into an inner wall of a body, adjusting a hitting interval and a hitting strength according to properties of a material to be crushed by adjusting a hitting distance of a piston, minimizing the loss of fluid in a duct by forming a cylindrical flow path between the body and the cylinder liner, and minimizing reduction of pressure by employing a circular valve to shorten the flow path, thereby remarkably improving performance.

BACKGROUND OF THE INVENTION

In general, a hydraulic hitting device mounted to construction machines such as an excavator or a loader etc. serves to crush or punch a concrete or a rock. There are a hydraulic and a hydraulic rock drill and so on.

The hydraulic hitting device includes a hitting body and a bit rotation mechanism (hereinafter, "operating unit") formed at the lower end thereof and having a bit rotated by a chisel or a rotary motor.

A piston is formed inside the hitting body of the hydraulic hitting device and serves to hit the end of the operating unit while being moved up and down by a hydraulic pressure.

FIG. 4 is a sectional view illustrating a state of mounting an operating unit 40 on a hitting body of a hydraulic rock drill according to the present invention. As shown, a bit rotation mechanism 2 having a bit 3 is formed at the lower end of the hitting body 1.

FIG. 6 illustrates a hydraulic breaker of the conventional hydraulic hitting device. As shown, the fixture 30 is formed at the lower end of the hitting body 1 and the operating unit 40 is fixed to the fixture 30.

The hitting body 1 includes a body 100 and an upper body 20. The piston 50 is formed at the inside of the body 10 and the upper body 20 is formed on the upper portion of the body 10.

A plurality of flow path grooves is formed at an inner wall of the body 10 and a plurality of flow path holes, which is in communication with the flow path grooves, is formed at the wall of the body 10.

The piston 50 of the hitting body 1 is moved up and down by means of the pressure difference between the upper and lower surfaces generated by the fluid flowing through the flow path grooves 11 and the flow path holes 12. At this time, the upper end of the operating unit 40 is repeatedly hit by the lower end of the piston 50.

The prior art on the hydraulic hitting devices are disclosed in Korean patent Nos. 1996-0006735, 0456786, 0998261, and 0772301 and Korean patent publication No. 2011-0086289.

SUMMARY OF THE INVENTION

However, the hitting body of the conventional hydraulic hitting device has the following problems.

(1) Since the large body should be overall precisely machined so as to minimize the clearance between the outer periphery and the inner wall off the piston, it takes a lot of the production cost and a long production time.

(2) Since the piston is shocked and reciprocated inside the body, it is accompanied by intense pressure and heat. Accordingly, since it is necessary to be manufactured by a special material and perform a special heat treatment, it takes a lot of the production cost and a long production time.

(3) When the high pressure port and the low pressure port is in communication with the inside of the body, since the duct should be formed long, it increases the loss of fluid in the duct.

(4) Since the valve is formed at the outside of the body, the pressure is reduced owing to the long flow path, thus the performance is bad.

(5) Since the hitting distance of the piston cannot be easily adjusted, the hitting strength cannot be controlled according to the properties of the material to be crushed.

In order to solve the above problems, there is provided a hitting body for a general hydraulic stroke device according to the present invention having a body, a piston formed at the inside of the body, and an upper body formed on the upper portion of the body including: a cylinder liner inserted into and formed at the inside of the body; at least one operating flow path hole and return flow path hole formed at a wall of the cylinder liner respectively; and a circular valve formed between the seal retainers, which are formed at the upper end thereof.

According to the hitting body for the hydraulic hitting device of the present invention has the following effects.

(1) The production costs and time can be reduced since only the cylinder liner inserted into the body requires to be machined precisely.

(2) The production costs and time can be reduced since only the cylinder requires to be treated by heat.

(3) It takes less time for machining since a high pressure port and a low pressure port communicate directly with a high pressure space groove and a low pressure space groove, the efficiency of the apparatus becomes good due to minimization of the loss of fluid in the duct.

(4) The performance is good since the circular valve is formed within the cylinder liner, thus the flow path becomes short and reduction of pressure is less.

(5) The hitting strength can be controlled according to the properties of the material to be crushed since a hitting distance and the hitting interval of the piston can be easily adjusted by opening or closing a short flow path hole using a hole adjuster.

BRIEF DESCRIPTION OF THE DRAWINGS

The above and other objects, features and advantages of the present invention will be more apparent from the following detailed description taken in conjunction with the accompanying drawings, in which.

DESCRIPTIONS ON REFERENCE NUMBERS FOR THE MAJOR COMPONENTS IN THE DRAWINGS

Figure 1:
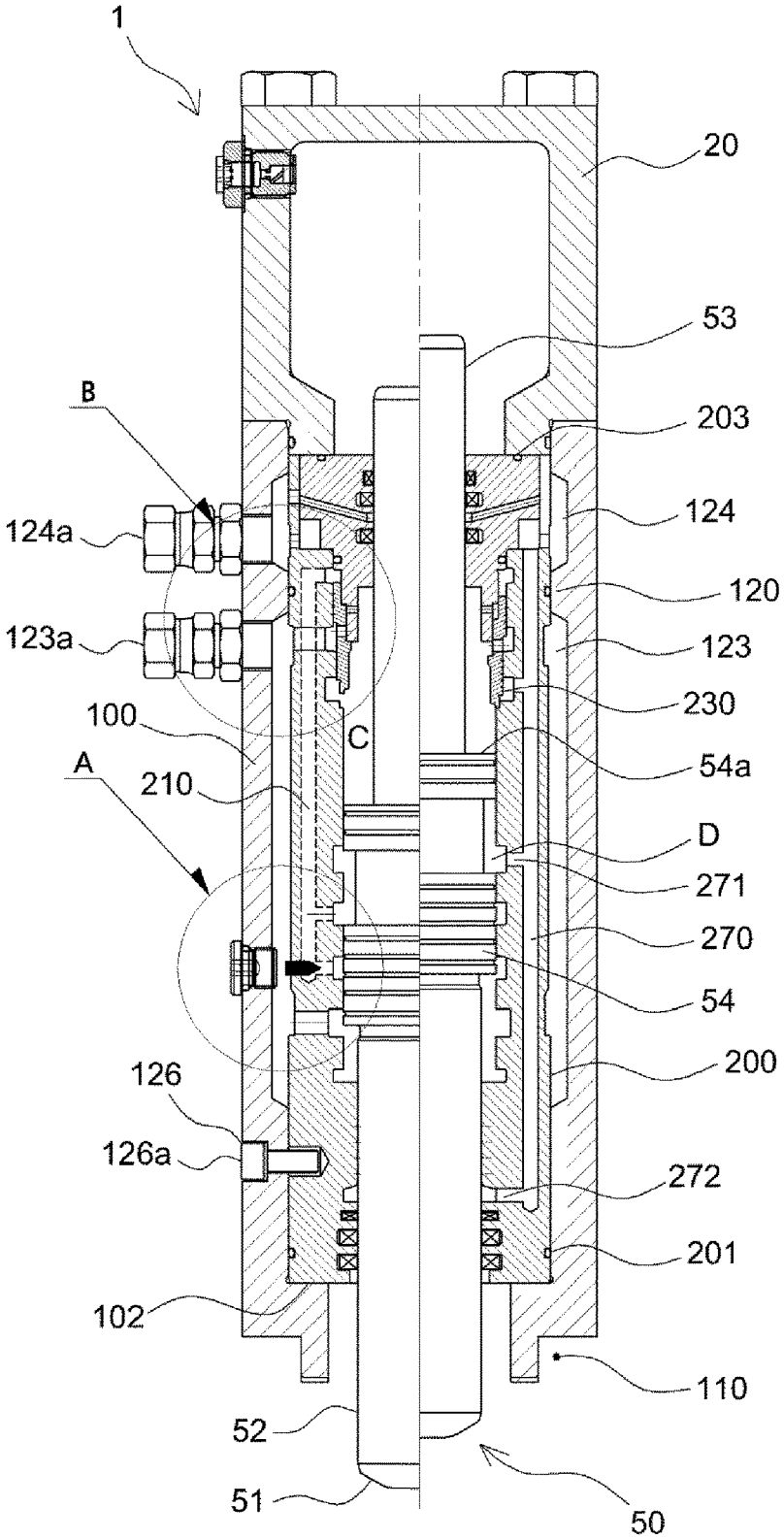
FIG. 1 is a side sectional view illustrating a hitting body for a hydraulic hitting device according to the present invention.
Figure 2:
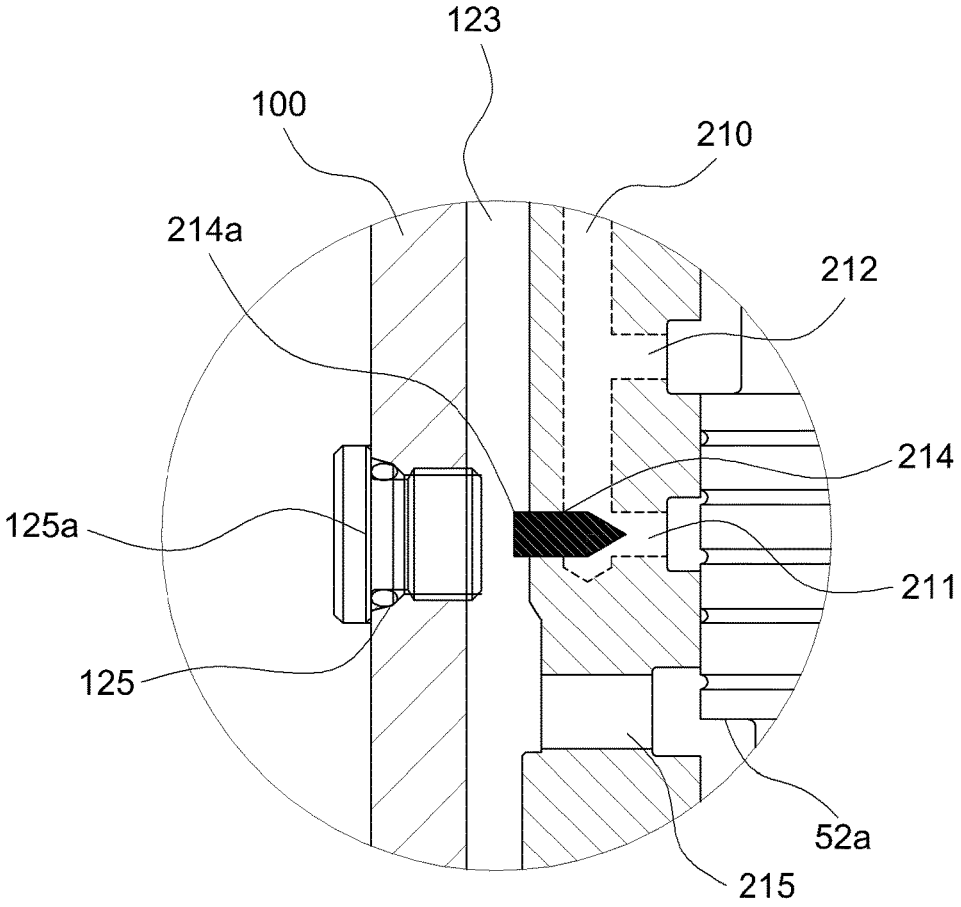
FIG. 2 is an enlarged a side sectional view illustrating "A" portion of a hitting body for a hydraulic hitting device according to the present invention.
Figure 3:
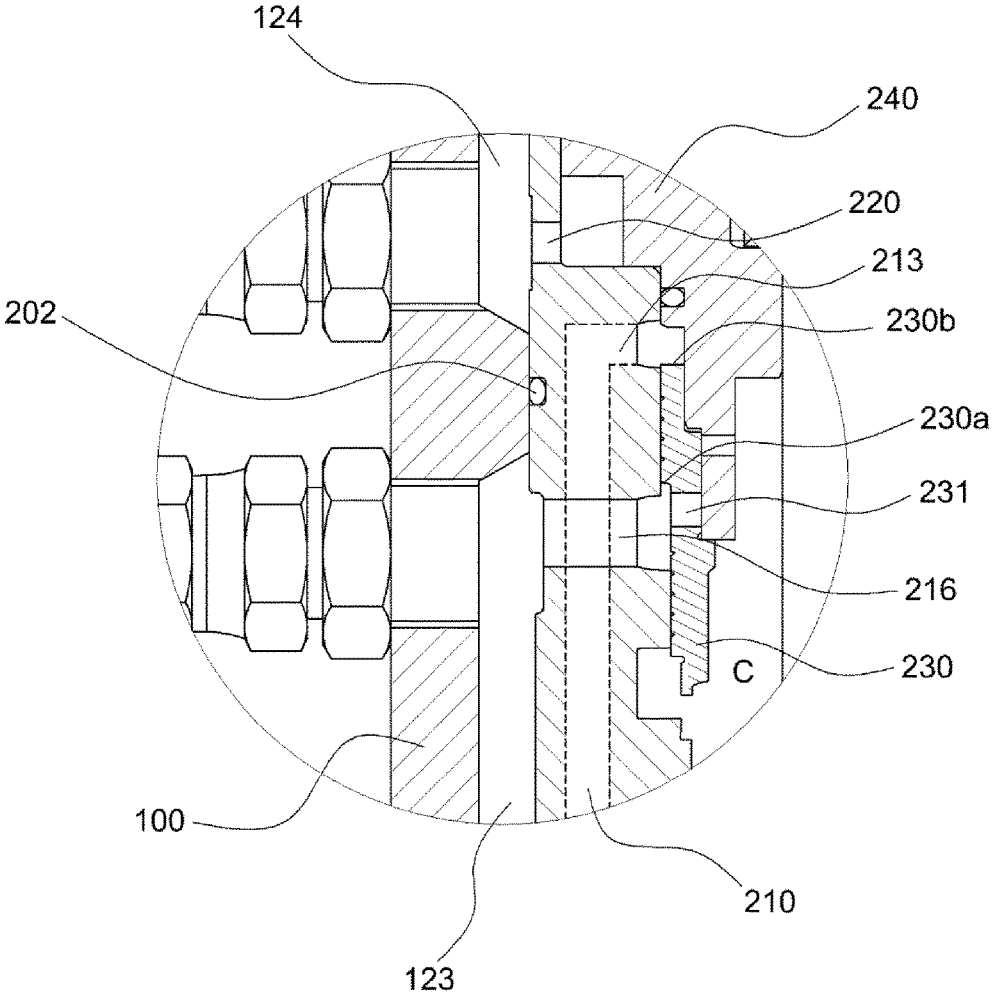
FIG. 3 is an enlarged a side sectional view illustrating "B" portion of a hitting body for a hydraulic hitting device according to the present invention.
Figure 4:
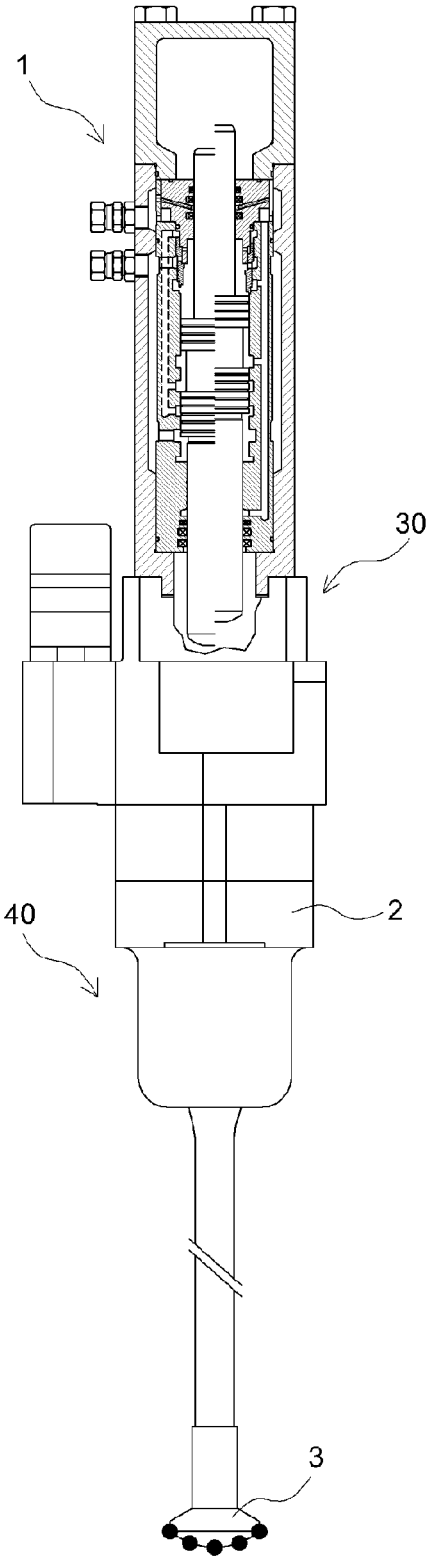
FIG. 4 is a side sectional view illustrating a state of mounting an operating unit on a hitting body for a hydraulic hitting device according to the present invention.

1: hitting body
10, 100: body
11: flow path groove
12: flow path hole
20: upper Body
30: fixture
40: operating unit
50: piston
51: hitting portion
52: lower piston
52*a*: lower projection
53: upper piston
54: operating portion
54*a*: operating projection
54*b*: upper middle operating projection
102: liner fixing projection
110: connecting portion
120: separating projection
123: high pressure space groove
123*a*: high pressure port
124: low pressure space groove
124*a*: low pressure port
125: adjusting groove
125*a*: adjusting cap
126: liner fixing hole
126*a*: liner fixing bolt
200: cylinder liner
201: bottom seal
202: middle seal
203: top seal
210: operating flow path hole
211: short stroke flow path hole
212 long stroke flow path hole
213: valve operating flow path hole
215: lower high pressure inlet hole
216: upper high pressure inlet hole
220: low pressure hole
230: circular valve
230*a*: valve middle area
230*b*: valve upper area
231: valve middle hole
240: seal retainer
270: return flow path hole
271: return hole
272: lower returns hole

DETAILED DESCRIPTION OF THE INVENTION

A hitting body 1 for a general hydraulic stroke device according to the present invention having a body 100, a piston 50 formed at the inside of the body 100, and an upper body 20 formed on the upper portion of the body 100 includes: a cylinder liner 200 inserted into and formed at the inside of the body 100; at least one operating flow path hole 210 and return flow path hole 270 formed at a wall of the cylinder liner 200 respectively; and a circular valve 230 formed between the seal retainers 240, which are formed at the upper end thereof.

The body 100 includes a connection portion 110 formed at a lower portion thereof; a hole penetrated through the inside thereof; the liner fixing projection 102 formed on the lower portion of the hole; and a high pressure space groove 123 and a low pressure space groove 124 formed at the inner wall thereof and bounded by a separating projection 120.

The high pressure space groove 123 of a cylinder shape formed long along the inner wall thereof and the low pressure space groove 124 of a cylinder shape formed long at the upper end of the inner wall of the body 100 are bounded by the separating projection 120.

A high pressure port 123*a* and a low pressure port 124*a* are formed at an upper outer wall of the body 100, the high pressure port 123*a* being in communication with the high pressure space groove 123 and the low pressure port 124*a* being communication with the low pressure space groove 124.

An adjusting hole 125 passed through the high pressure space groove 123 is formed at the outer wall of the body 100 and has an adjusting cape 125*a*.

A liner fixing hole 126 is formed at the bottom of the body 100 and a liner fixing bolt 126*a* is inserted into the liner fixing hole 126.

The upper body 20 is formed at the upper portion of the body 100. If necessary, a gas such as nitrogen is filled in the inside thereof so as to increase the speed at the time of the fall of the piston 50.

An accumulator may be attached to the side surface of the body 100. The accumulator is configured to be communicated with the high pressure space groove 123.

The cylinder liner 200 is inserted into the inside of the body 100. The cylinder liner 200 is inserted into the upper portion of the body 100 and the lower portion of the cylinder liner 200 is fixed to the liner fixing projection 102.

The upper portion of cylinder liner 200 is fixed to the body 100, while the upper body 20 pressing the seal retainer 240.

The cylinder liner 200 is formed in a cylindrical shape and manufactured by means of the precision processing and heat treatment, so that the piston 50 ascends and descends very accurately along the inner wall of the cylinder liner 200.

The cylinder liner 200 has a plurality of sealing portions on the outer periphery thereof and includes bottom and middle seals 201 and 202 and a top seal 203 formed on the seal retainer 240.

The bottom and middle seals 201 and 202 are configured to be in contact with the upper and lower portions of the inner wall of the body 100 respectively and the middle seal 202 is configured to be in contact with the separating projection 120.

The bottom and middle seals 201 and 202 and the top seal 203 are configured to prevent the fluid flowed in the high pressure space groove 123 and the low pressure space groove 124 from being leaked to outside.

A lower high pressure inlet hole 215, an upper high pressure inlet hole 216, and a low pressure hole 220 are penetrated through the inner and outer walls of the cylinder liner 200. The lower high pressure inlet hole 215 and the upper high pressure inlet hole 216 is in communication with the high pressure space groove 123 and the low pressure hole 220 is in communication with the low pressure space groove 124.

At least one operating flow path hole 210 and return flow path hole 270 are formed at the wall of the cylinder liner 200 respectively.

The operating flow path hole 210 includes a short stroke flow path hole 211 and a long stroke flow path hole 212 penetrated through the inner wall of the cylinder liner 200 and a valve operating flow path hole 213 formed at the upper portion thereof.

The operating flow path hole 210 further includes a closing hole 214 corresponding to the short stroke flow path hole 211 and penetrated to the outer wall of the cylinder liner 200. Also, a hole adjuster 214*a* is inserted into the closing hole. The hole adjuster 214*a* may be a set screw or a pin.

The upper high pressure inlet hole 216 is configured to pass through a piston upper chamber C and can be opened and closed by the circular valve 230.

The return flow path hole 270 is a flow path for discharging the fluid to outside during the operation of the piston 50. The return flow path hole 270 includes a return hole 271 passed through a piston operating chamber D, which is formed between the outer wall of the operating portion 54 and the inner wall of the cylinder liner 200. Also, the upper portion of the return flow path hole 270 is in communication with the low pressure hole 220 and the upper portion of the return flow path hole 270 is in communication with the lower return hole 272.

The piston 50 includes an operating portion 54 formed at the middle portion thereof, a lower piston 52 formed at the lower portion of the operation part 54, an upper piston 53 formed at the upper portion thereof, and a hitting portion 51 formed at a lower end of the lower piston 52.

The diameter of the lower piston 52 is larger than that of the upper piston 53. Accordingly, the entire area of a lower projection 52*a* formed the lower portion of the operating portion 54 is less than that of an operating projection 54*a* formed at the upper portion of the operating portion 54.

A fixture 30 is connected to the connecting portion 110 of the body 100 and an operating unit 40 is formed at the fixture 30. The operating unit 40 may be a chisel or bit rotation mechanism and so on.

A fixing bracket is formed at the outside of the body 100 so as to be fixed to a heavy equipment such as an excavator or a loader etc. Here, a fluid hose connected to the heavy equipment is connected to the high pressure port 123*a* and the low pressure port 124*a* to be used.

Another embodiment of the present invention is provided a hitting body 1 for a general hydraulic stroke device according to the present invention having a body 100, a piston 50 formed at the inside of the body 100, and an upper body 20 formed on the upper portion of the body 100 includes: a cylinder liner 200 inserted into and formed at the inside of the body 100; at least one operating flow path hole 210 and return flow path hole 270 formed at a wall of the cylinder liner 200 respectively; and a circular valve 230 formed between the seal retainers 240, which are formed at the upper end thereof.

Figure 5:
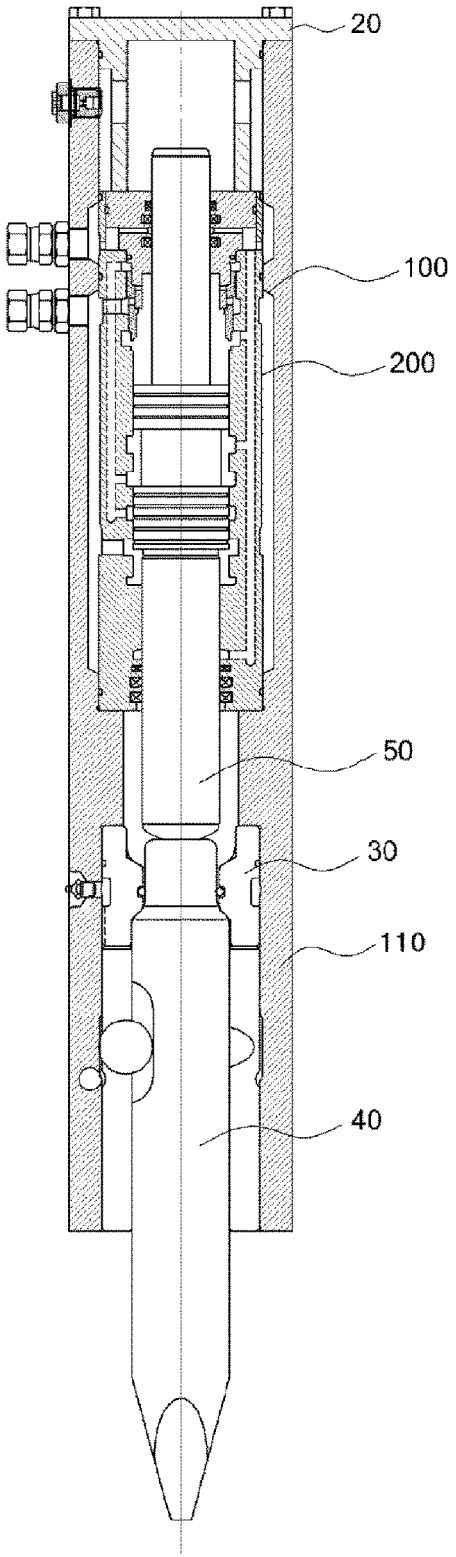
FIG. 5 is a side sectional view illustrating a hitting body for a hydraulic hitting device according to another embodiment of the present invention.
Figure 6:
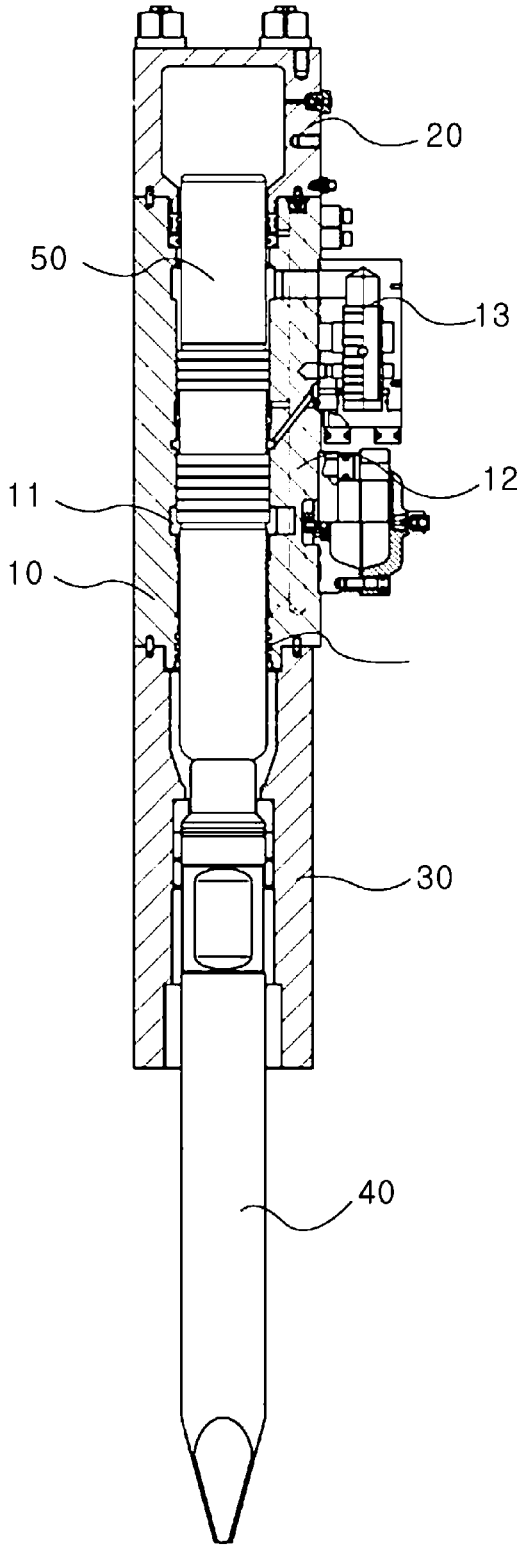
FIG. 6 illustrates a hydraulic breaker of the conventional hydraulic hitting device.

As shown in FIG. 5, further another embodiment of the present invention is provided a hitting body 1 for a general hydraulic stroke device having a body 100, a piston 50 formed at the inside of the body 100, and an upper body 20 formed on the upper portion of the body 100 includes: the body 100 having a long upper portion and a connecting portion 110 formed long on a lower end thereof, the upper body 20 integrally formed on the long upper portion of the body 100; a fixture 30 and an operating unit 40 inserted into and mounted on an inside of the connecting portion 110; a cylinder liner 200 inserted into and formed at the inside of the body 100; at least one operating flow path hole 210 and return flow path hole 270 formed at a wall of the cylinder liner 200 respectively; and a circular valve 230 formed between the seal retainers 240, which are formed at the upper end thereof.

Hereinafter, the manufacturing method and operation of the hitting body for the general hydraulic stroke device according to a preferred embodiment of the present invention will be described.

The body 100 is processed in the normal machining and it does not have to perform a heat treatment. However, the high pressure groove 123 and low pressure space groove 124 having a sufficient depth are formed on the inner wall thereof and the high pressure port 123*a* and the low pressure port 124*a* communicated with the high pressure space groove 123 and the low pressure space groove 124 are directly formed on the outer wall.

The cylinder liner 200 is machined precisely to the inner wall so as to precisely slide on the outer surface of the piston 50.

In addition, the cylinder liner 200 is processed through the heat treatment, because there is severely worn due to the reciprocating motion of the piston 50.

The cylinder liner 200 is inserted into the body 100 through the upper portion thereof.

At this time, the lower end of the cylinder liner 200 is touched with and fixed to the liner fixing projection 102 formed at the inside of the body 100 and the liner fixing bolt 126*a* is fixed to the outside of the body, so that the cylinder liner 200 is not rotated by the impact.

The piston 50 is inserted into the cylinder liner 200 and the circular valve 230 and the seal retainer 240 are fixed to the upper portion thereof. Then, the upper body 20 is fixed to the upper portion of the body 100.

In a state assembled as described above, the fixture 30 is connected to the connecting portion 110 of the body 100 and the operating unit 40 is fixed to the fixture 30. Then, the body 100 is connected to the heavy equipment such as the excavator and the fluid hoses are connected to the to the high pressure port 123*a* and the low pressure port 124*a* so as to prepare a crushing operation.

In the operation of the piston 50, the fluid introduced through the high pressure port 123*a* is introduced into the cylinder liner 200 through the lower high pressure hole 215 along the high pressure space groove 123, so that it boosts the lower projection 52*a* of the piston 50. At this time, the piston upper chamber C is a low pressure state.

According to the elevation of the piston 50, when the lower projection 52*a* passes through a short stroke flow path hole 211 or a long stroke flow path hole 212, since the whole operating flow path hole 210 is high pressure state, the high pressure is applied to a valve upper area 230*b* and the valve middle area 230*a* at the same time while the fluid being introduced into the valve operating flow path hole 213. However, since the valve upper area 230*b* is larger than the valve middle area 230*a*, the circular valve 230 is pushed toward the lower portion thereof, so that the upper high pressure inlet hole 216 is in communication with the piston upper chamber C through a valve middle hole 231 and then, the fluid of the high pressure is flowed into the piston upper chamber C, thereby applying the pressure to the operating projection 54*a*.

The high pressure applied to the operating projection 54*a* is the same as the pressure applied to the lower projection 52*a*. However, since the entire area of operating projection 54*a* is larger than that of the lower projection 52*a*, the operating projection 54*a* is larger than the lower projection 52*a* in terms of the magnitude of the pushing force. Accordingly, the piston is momentarily transferred toward the lower portion thereof, so that the hitting portion 51 of the piston 50 hits the upper portion of the operating unit 40.

Then, the piston operating chamber D is instantaneously communicated with the return hole 271, so that the valve operating flow path hole 213 of the circular valve 230 becomes a low pressure state and then, the circular valve 230 is again ascended to close the upper high pressure inlet hole 216. Accordingly, the low pressure hole 220 is opened, so that the fluid of the piston upper chamber C is discharged.

At this time, since the short stroke flow path hole 211 and the long stroke flow path hole 212 is also blocked by the outer wall of the operating portion 54 of the piston 50, the low pressure is maintained inside the operating flow path hole 210.

As described above, the high pressure and the low pressure is repeatedly crossed in the piston upper chamber C, so that the piston 50 is moved up and down.

At this time, the fluid leaked through the gap between the lower piston 52 and the inner wall of the cylinder liner 200 is joined with the return flow path hole 270 through the lower return hole 272.

The short stroke the flow path hole 211 can be closed by the hole adjuster 214*a*. When the short stroke flow path hole 211 is closed, the piston 50 rises to the long stroke flow path hole 212, so that the circular valve 230 is operated, thereby increasing the hitting distance of the piston 50.

The short stroke flow path hole 211 and the long stroke flow path hole 212 serves to form the high pressure in the operating flow path hole 210 so as to operate the circular valve 230 and form the high pressure in the piston upper chamber C. Accordingly, when the short stroke flow path hole 211 is opened, the hitting distance of the piston 50 and the hitting interval are shortened. Meanwhile, when the short stroke flow path hole 211 is closed and the long stroke flow path hole 212 is opened, the hitting distance of the piston 50 and the hitting interval are increased.

As described above, since the hitting distance and the hitting time can be adjusted, it can selectively operate the equipment according to the type of the crushing matters.

In addition, since the high pressure port 123*a* and the low pressure port 124*a* are directly attached to the high pressure space groove 123 and the low pressure space groove 124 formed at the outer wall of the body 100 respectively, the flow path of the fluid is shortened.

Figure 7:
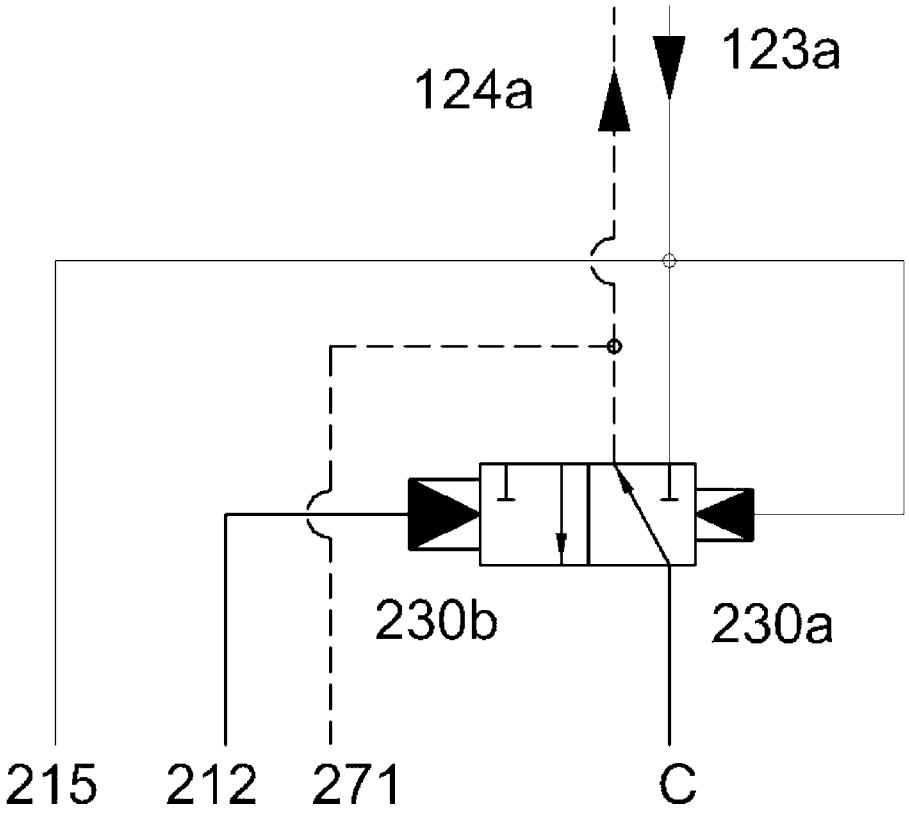
FIG. 7 illustrates a basic hydraulic circuit according to the present invention.

According to the hitting body for the hydraulic hitting device of the present invention, the production costs and time can be reduced since only the cylinder liner inserted into the body requires to be machined precisely; the production costs and time can be reduced since only the cylinder requires to be treated by heat; it takes less time for machining since a high pressure port and a low pressure port communicate directly with a high pressure space groove and a low pressure space groove, the efficiency of the apparatus becomes good due to minimization of the loss of fluid in the duct; the performance is good since the circular valve is formed within the cylinder liner, thus the flow path becomes short and reduction of pressure is less; and the hitting strength can be controlled according to the properties of the material to be crushed since a hitting distance and the hitting interval of the piston can be easily adjusted by opening or closing a short flow path hole using a hole control unit As show in FIG. 7, the valve of the present invention includes the high pressure port 123*a* and the low pressure port 124*a*. Also, the valve includes the valve middle area 230*a* and the valve upper area 230*b*. Here, the valve middle area 230*a* is connected to the lower high pressure inlet hole 215, the valve upper area 230*b* is connected to the long stroke flow path hole 212 is connected to the low pressure port 124*a*, and the return hole 271 is connected between the low pressure port 124*a* and the connecting middle portion of the valve, so that it can be applied to the hydraulic circuit.

The present invention has been described according to preferred embodiments such as the breaker with reference to the accompanying drawings. However, from the basic hydraulic circuit shown in FIG. 7, those skilled in the art will appreciate that various modifications, additions and substitutions are possible, without departing from the scope and spirit of the invention as disclosed in the accompanying claims. Also, the present invention is applied to the other various hydraulic hitting devices to be utilized.

What is claimed is:

1. A hitting body for a hydraulic stroke device, wherein the hitting body includes a body (100), and a piston (50) reciprocally positioned in the body (100), wherein the body (100) comprises a high pressure space groove (123) and a low pressure space groove (124) formed at an inner wall of the body, the high pressure space groove (123) and the low pressure space groove (124) bounded by a separating projection (120), wherein a high pressure port (123*a*) is connected to the high pressure space groove (123) to supply fluid in order to operate the piston (50), and a low pressure port (124*a*) is connected to the low pressure space groove (124) to discharge the fluid, a cylinder liner (200) of annular shape formed of a singular wall member and positioned in an inner space of the body (100), the cylinder liner (200) including an upper high pressure inlet hole (216) and a lower high pressure inlet hole (215) formed through the wall of the annular cylinder liner (200) at an upper side and a lower side of the cylinder liner (200), respectively, to supply a high pressure fluid to an interior area of the cylinder liner (200), and the cylinder liner (200) further including a low pressure hole (220) formed through the wall of the annular cylinder liner (200) at a location corresponding to the low pressure space groove (124) so as to discharge the fluid to the low pressure space groove (124), and an operating flow path (210) and a return flow path (270), both formed in a longitudinal direction within the wall of the cylinder liner (200), a seal retainer (240) of annular shape mounted to an upper end of the body (100), a circular valve (230) of annular shape positioned between a lower portion of the annular seal retainer (240) and an upper portion of the cylinder liner (200) in a coaxial relation with the piston (50) and the seal retainer (240), wherein the cylinder liner (200) further includes a valve operating flow path hole (213) in fluid communication with an upper area of the operating flow path (210), and a short stroke flow path hole (211) and a long stroke flow path hole (212) in fluid communication with a lower area of the operating flow path (210), wherein an upper side of the return flow path (270) is connected with the low pressure hole (220), and a lower side of the return flow path (270) is connected with a lower return hole (272), and an intermediate side of the return flow path (270) is connected with a return hole (271) which is in fluid communication to a piston operating chamber (D) disposed between the piston (50) and the interior surface of the cylinder liner (200), wherein the piston (50) includes an operating portion (54) at an intermediate side, a lower piston portion (52) at a lower side, and an upper piston portion (53) at an upper side of the piston (50), wherein the lower piston portion (52) includes a lower projection (52*a*) configured to move the piston (50) to an upward direction by the pressure of the high pressure fluid introduced through the lower high pressure inlet hole (215), while allowing the short stroke flow path hole (211) and the long stroke flow path hole (212) to be opened as the lower projection (52*a*) passes in the upward direction, wherein the circular valve (230) includes a valve upper area (230*b*) and a valve middle area (230*a*), the valve upper area (230*b*) having a surface area greater than that of the valve middle area (230*a*) so as to enable the circular vale (230) to move in a downward direction by the pressure of the fluid supplied through the valve operating flow path hole (213), wherein the circular valve (230) further includes a valve middle hole (231) configured to allow the fluid supplied via the upper high pressure inlet hole (216) to flow to a piston upper chamber (C) when the circular valve (230) is moved in the downward direction, wherein the piston (50) further includes an operating projection (54*a*) at an upper side of the lower projection (52*a*), the operating projection (54*a*) having a surface area greater than that of the lower projection (52*a*) so as to enable the piston (50) to move in a downward direction by the pressure of the fluid introduced in the piston upper chamber (C) through the upper high pressure inlet hole (216) and the valve middle hole (231) when the circular valve (230) is moved in the downward direction, and wherein the piston operating chamber (D) is in fluid communication with the return hole (271) to enable the circular valve (230) to move in the upward direction as the valve operating flow path hole (213) becomes a lower pressure state.

2. The hitting body for a hydraulic hitting device as claimed in claim 1, wherein the cylinder liner (200) further includes:

a closing hole (214) formed through an outer wall of the cylinder liner (200) at a location corresponding to the short stroke flow path hole (211);

a hole adjuster (214*a*) inserted into the closing hole (214);

an adjusting hole (125) formed at the outer wall of the body (100) so as to connect to the high pressure space groove (123) at a location corresponding to the closing hole (214); and an adjusting cap (125*a*) coupled to the adjusting hole (125).

3. The hitting body for a hydraulic hitting device as claimed in claim 1, wherein a liner fixing hole (126) is formed at a lower side of the body (100), and a liner fixing bolt (126*a*) is inserted to the liner fixing hole (126).

* * * * *